US009103304B2

(12) United States Patent
Hommes et al.

(10) Patent No.: US 9,103,304 B2
(45) Date of Patent: Aug. 11, 2015

(54) INTEGRATED INTAKE MANIFOLD AND COMPRESSOR

(75) Inventors: Daniel J. Hommes, Metamora, MI (US); Carnell E. Williams, Southfield, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 578 days.

(21) Appl. No.: 13/483,570

(22) Filed: May 30, 2012

(65) Prior Publication Data

US 2013/0319380 A1 Dec. 5, 2013

(51) Int. Cl.

| | |
|---|---|
| ***F02B 33/00*** | (2006.01) |
| ***F02B 75/22*** | (2006.01) |
| ***F02B 25/00*** | (2006.01) |
| ***F02M 35/10*** | (2006.01) |
| ***F02B 33/34*** | (2006.01) |
| ***F02B 67/10*** | (2006.01) |
| ***F02M 35/116*** | (2006.01) |
| ***F02B 39/04*** | (2006.01) |
| ***F02B 39/10*** | (2006.01) |
| *F02B 33/40* | (2006.01) |

(52) U.S. Cl.

CPC ..... *F02M 35/10052* (2013.01); *F02B 33/34* (2013.01); *F02B 39/04* (2013.01); *F02B 39/10* (2013.01); *F02B 67/10* (2013.01); *F02M 35/116* (2013.01); *F02B 33/40* (2013.01)

(58) Field of Classification Search

CPC ..... F02B 33/40; F02B 39/00; F02B 67/10; F02C 6/12; F02M 354/10052; F02M 35/116

USPC ..... 123/559.1, 559.3, 561, 54.4, 69 V

See application file for complete search history.

(56) References Cited

U.S. PATENT DOCUMENTS

| | | | | | |
|---|---|---|---|---|---|
| 1,955,799 | A | * | 4/1934 | Fielden | 123/54.4 |
| 2,344,366 | A | * | 3/1944 | Price | 415/122.1 |
| 2,516,228 | A | * | 7/1950 | Macy et al. | 123/69 R |
| 2,654,355 | A | * | 10/1953 | Scheiterlein | 123/54.4 |
| 2,746,435 | A | * | 5/1956 | Kremser | 123/54.4 |
| 2,769,435 | A | * | 11/1956 | Cass | 123/69 V |
| 2,777,632 | A | * | 1/1957 | Kishline et al. | 60/605.1 |
| 2,799,258 | A | * | 7/1957 | Black | 123/54.4 |
| 2,858,666 | A | * | 11/1958 | Fullemann | 60/605.1 |
| 2,903,847 | A | * | 9/1959 | Boyd | 60/605.1 |
| 3,161,182 | A | * | 12/1964 | Albinson et al. | 123/54.6 |
| 3,673,798 | A | * | 7/1972 | Kuehl | 60/605.1 |
| 3,894,815 | A | * | 7/1975 | Beeton | 417/360 |
| 3,938,481 | A | * | 2/1976 | Morton | 123/69 V |
| 4,016,839 | A | * | 4/1977 | Morton | 123/69 V |

(Continued)

FOREIGN PATENT DOCUMENTS

| | | | | | |
|---|---|---|---|---|---|
| GB | 407190 | A | * | 3/1934 | F02B 37/02 |
| GB | 689660 | A | * | 4/1953 | F02B 33/00 |

(Continued)

*Primary Examiner* — Thai Ba Trieu

(74) *Attorney, Agent, or Firm* — Quinn Law Group, PLLC

(57) ABSTRACT

An induction system for an internal combustion engine having at least one cylinder includes a centrifugal compressor configured to pressurize an airflow being received from the ambient. The induction system also includes an intake manifold configured to channel the pressurized airflow to the at least one cylinder. The centrifugal compressor is disposed within and integral to the intake manifold. An internal combustion engine employing such an induction system is also disclosed.

14 Claims, 3 Drawing Sheets

(56) References Cited

U.S. PATENT DOCUMENTS

| | | | | |
|---|---|---|---|---|
| 4,537,173 | A * | 8/1985 | Norris | 123/592 |
| 5,197,427 | A * | 3/1993 | Masuda et al. | 123/559.1 |
| 5,314,314 | A * | 5/1994 | Hinkle | 417/364 |
| 5,359,855 | A * | 11/1994 | Klaue | 60/607 |
| 5,911,211 | A | 6/1999 | Uchida | |
| 6,739,292 | B1 * | 5/2004 | Neese | 123/69 V |
| 7,261,513 | B2 * | 8/2007 | Umeyama et al. | 415/52.1 |
| 7,694,667 | B2 * | 4/2010 | Williams et al. | 123/559.1 |
| 8,118,543 | B2 * | 2/2012 | Umeyama et al. | 415/204 |
| 8,464,696 | B2 * | 6/2013 | Liimatta | 123/559.1 |
| 8,632,304 | B2 * | 1/2014 | Sweetland et al. | 415/204 |
| 2008/0223037 | A1 | 9/2008 | Ren et al. | |
| 2010/0031926 | A1 * | 2/2010 | Magnuson | 701/104 |
| 2010/0166539 | A1 * | 7/2010 | Ibaraki et al. | 415/148 |
| 2011/0067680 | A1 | 3/2011 | Williams et al. | |
| 2011/0255952 | A1 | 10/2011 | Williams et al. | |
| 2012/0124994 | A1 | 5/2012 | Hommes et al. | |

FOREIGN PATENT DOCUMENTS

| | | | | |
|---|---|---|---|---|
| GB | 2123895 | A * | 2/1984 | F02B 37/12 |
| WO | WO 0068552 | A1 * | 11/2000 | F02B 38/34 |

* cited by examiner

INTEGRATED INTAKE MANIFOLD AND COMPRESSOR

TECHNICAL FIELD

The present disclosure relates to an intake manifold with an integrated compressor for an internal combustion engine.

BACKGROUND

An intake manifold or inlet manifold is the part of an engine that supplies air to the engine's cylinders. As known in the art, mechanical air compressors or superchargers may be used to generate forced induction in internal combustion engines.

Typically, such compressors or superchargers are driven by the subject engine to increase a mass flow-rate of air communicated to the engine's cylinders, thus generating what is called boost pressure to the cylinders via the intake manifold. Superchargers may be either positive displacement or compressor type.

The increased mass flow-rate of air in turn provides more oxygen to support combustion than would be available in a naturally aspirated engine, which allows more fuel to be burned inside the engine's cylinders. Such increased amount of fuel and air being burned results in enhanced engine volumetric efficiency and greater power output.

SUMMARY

One embodiment of the disclosure is directed to an induction system for an internal combustion engine having at least one cylinder. According to the embodiment, the induction system includes a centrifugal compressor configured to rotate about a first axis and pressurize an airflow being received from the ambient. The induction system also includes an intake manifold configured to channel and deliver the pressurized airflow to the at least one cylinder. The centrifugal compressor is disposed within and integral to the intake manifold.

The intake manifold may include a diffuser positioned downstream of the compressor and configured to receive the pressurized airflow therefrom. The diffuser may be configured as one of a volute and a flat plate.

The intake manifold may include a diffuser positioned downstream of the compressor and configured to receive the pressurized airflow therefrom.

The intake manifold may additionally include a plenum positioned downstream of the diffuser and configured to receive the pressurized airflow therefrom.

The at least one cylinder may include a plurality, particularly an even number, of cylinders disposed in a "V" arrangement. In such a case, the intake manifold may be configured to be positioned in a valley of the "V" arrangement. Furthermore, the intake manifold may additionally include a plurality of runners, each runner configured to deliver the pressurized airflow to one of the plurality of engine's cylinders.

The centrifugal compressor may be driven by the crankshaft via a drive mechanism. The drive mechanism may include at least one of a gear-, a chain-, and a belt-drive.

The engine may additionally include a crankshaft configured to be rotated about a second axis by the at least one cylinder. Furthermore, the first axis may be substantially orthogonal to the second axis.

Another embodiment of the invention is directed to an internal combustion engine having the induction system described above. The engine may include an intake air duct configured to deliver the airflow from the ambient to the induction system.

The above features and advantages, and other features and advantages of the present disclosure, will be readily apparent from the following detailed description of the embodiment(s) and best mode(s) for carrying out the described invention when taken in connection with the accompanying drawings and appended claims.

DETAILED DESCRIPTION

Figure 1:
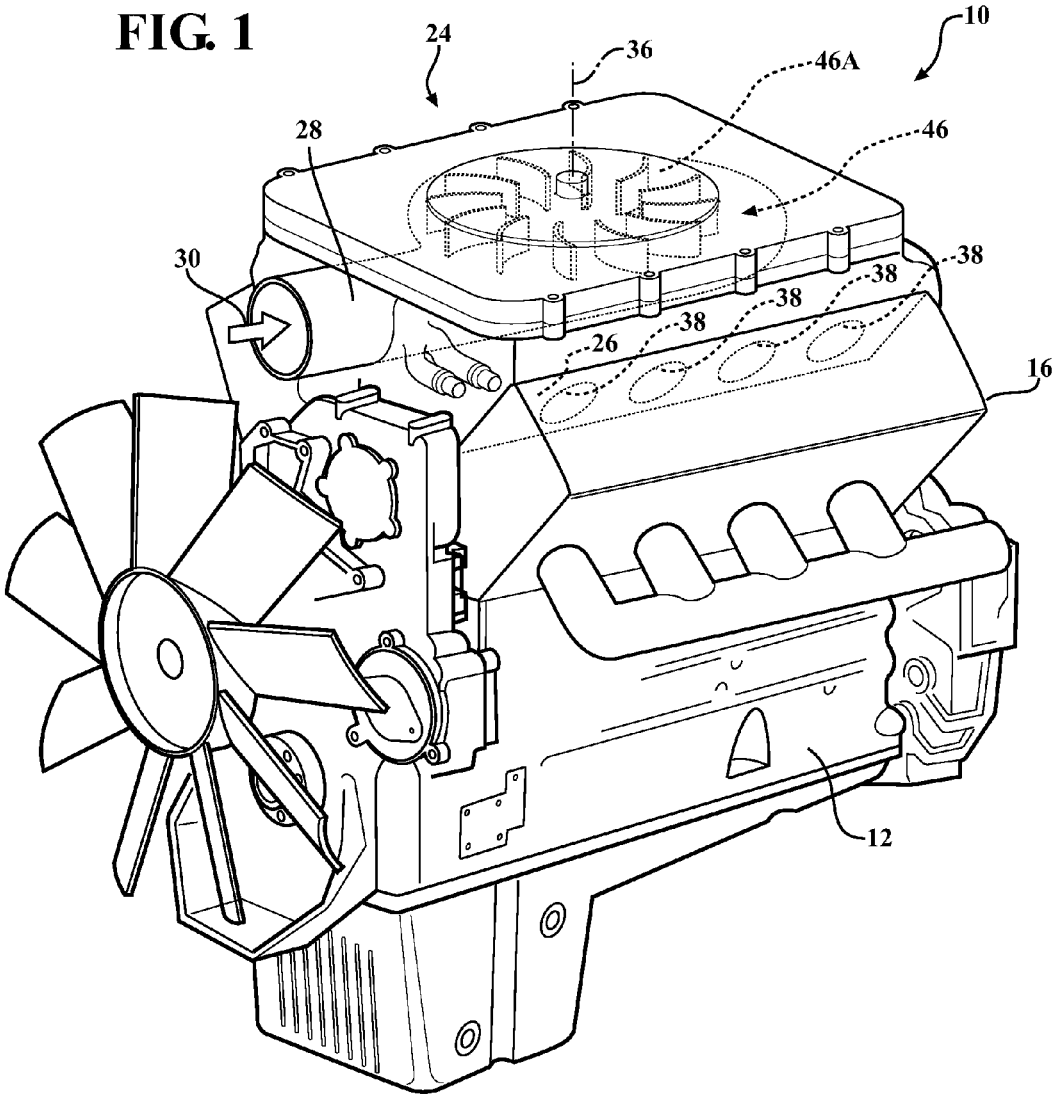
FIG. 1 is a schematic front view of an engine having an induction system with an integrated centrifugal compressor and a vane type of a volute diffuser positioned downstream of the compressor according to one embodiment of the disclosure.

Referring to the drawings wherein like reference numbers correspond to like or similar components throughout the several figures, FIG. 1 illustrates an internal combustion engine 10. The engine 10 also includes a cylinder block 12 with a plurality of cylinders 14 arranged therein. As shown, the engine 10 also includes a pair of cylinder heads 16. The engine 10 is depicted as having a multi-cylinder "V" type arrangement having an even number of cylinders 14. Although a "V" type cylinder arrangement is shown, any other cylinder arrangement, such as an inline type, is equally appropriate.

Each cylinder 14 includes a piston 18 configured to reciprocate therein. Combustion chambers 20 are formed within the cylinders 14 between the bottom surface of the cylinder heads 16 and the tops of the pistons 18. As known by those skilled in the art, a combustion chamber such as the combustion chamber 20 is configured to receive fuel and air for subsequent combustion of the fuel-air mixture therein. The engine 10 also includes a crankshaft 22 configured to rotate within the cylinder block 12. The crankshaft 22 is rotated by the pistons 18 as a result of an appropriately proportioned fuel-air mixture being burned in the combustion chambers 20.

Figure 2:
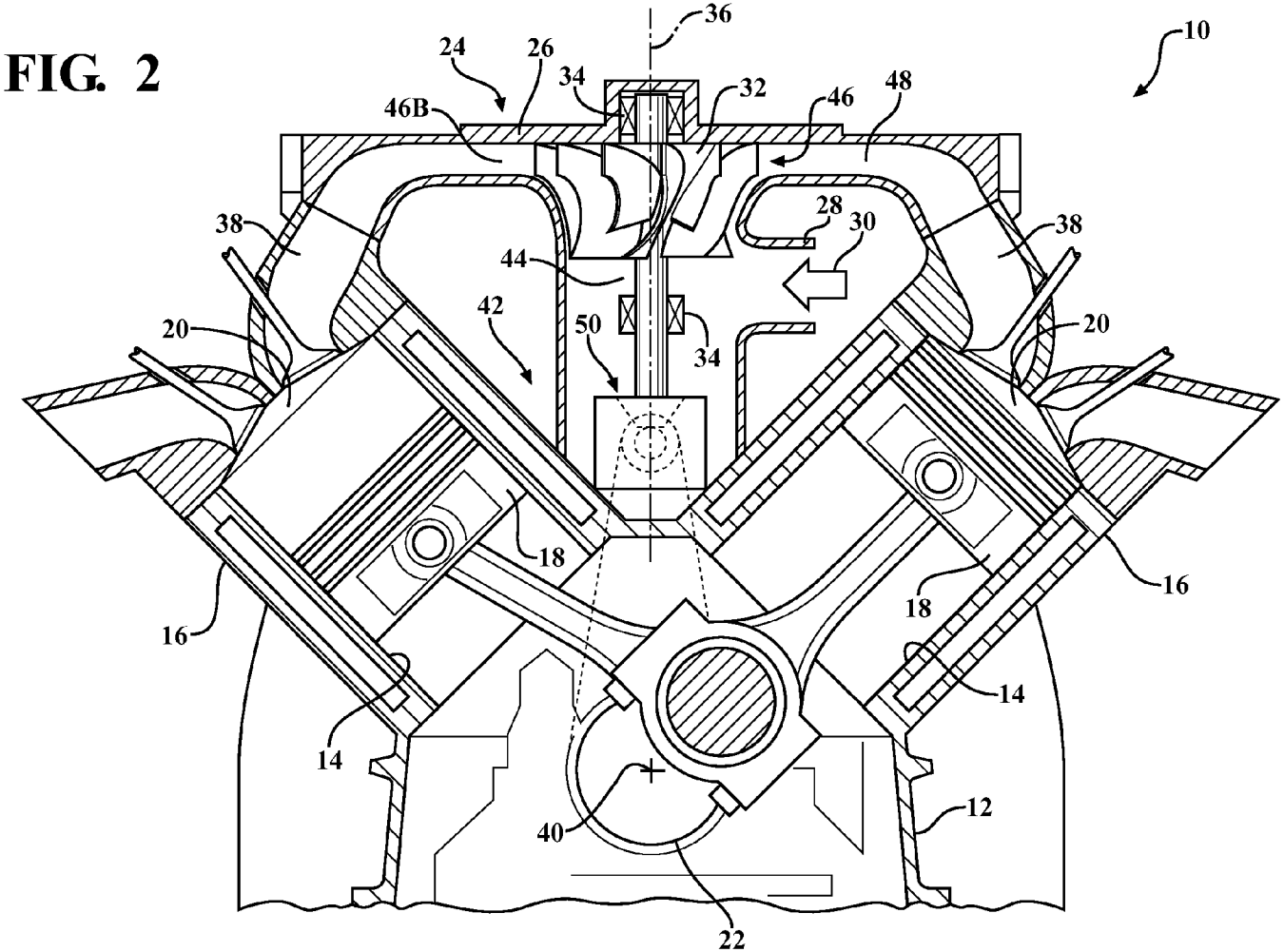
FIG. 2 is a schematic, cross-sectional view of the induction system having an integrated centrifugal compressor and a flat- or parallel-plate type of a diffuser positioned downstream of the compressor according to another embodiment of the disclosure.

The engine 10 also includes an induction system 24. The induction system 24 includes an intake manifold 26 and an intake air duct 28 configured to deliver an airflow 30 from the ambient to the intake manifold. As shown in FIG. 2, the intake manifold 26 includes a centrifugal compressor 32. As also shown, the compressor 32 is disposed within and is integral to the intake manifold 26. The compressor 32 is rotatably supported via bearings 34 within the intake manifold 26, and is configured to rotate about a first axis 36 and pressurize the airflow 30 that is received by the intake manifold 26 from the ambient. The intake manifold 26 additionally includes a plurality of runners 38, wherein each runner is configured to deliver the pressurized airflow 30 to one of the cylinders 14. Accordingly, the intake manifold 26 is configured to channel the pressurized airflow generated by the compressor 32 to the combustion chambers 20.

As shown in FIG. 2, the crankshaft 22 is configured to be rotated about a second axis 40 by the cylinders 14. As additionally shown, the compressor 32 may be disposed within the intake manifold 26 such that the first axis 36 is substantially orthogonal to the second axis 40. Although the compressor 32 is shown as being substantially orthogonal to the crankshaft 22 for advantageous packaging of the compressor within the intake manifold, the first axis 36 may also be disposed at any specifically selected angle with respect to the second axis 40. Furthermore, as shown the intake manifold 26 may be positioned in a valley 42 of the "V" arrangement of the engine 10. The above described positioning of the compressor 32 within the intake manifold 26 may facilitate a compact assembly of the intake manifold. Moreover, positioning of the entire assembly of the intake manifold 26 in the valley 42 may facilitate more compact packaging of the engine 10 that is comparable to that of a naturally aspirated engine.

Figure 3:
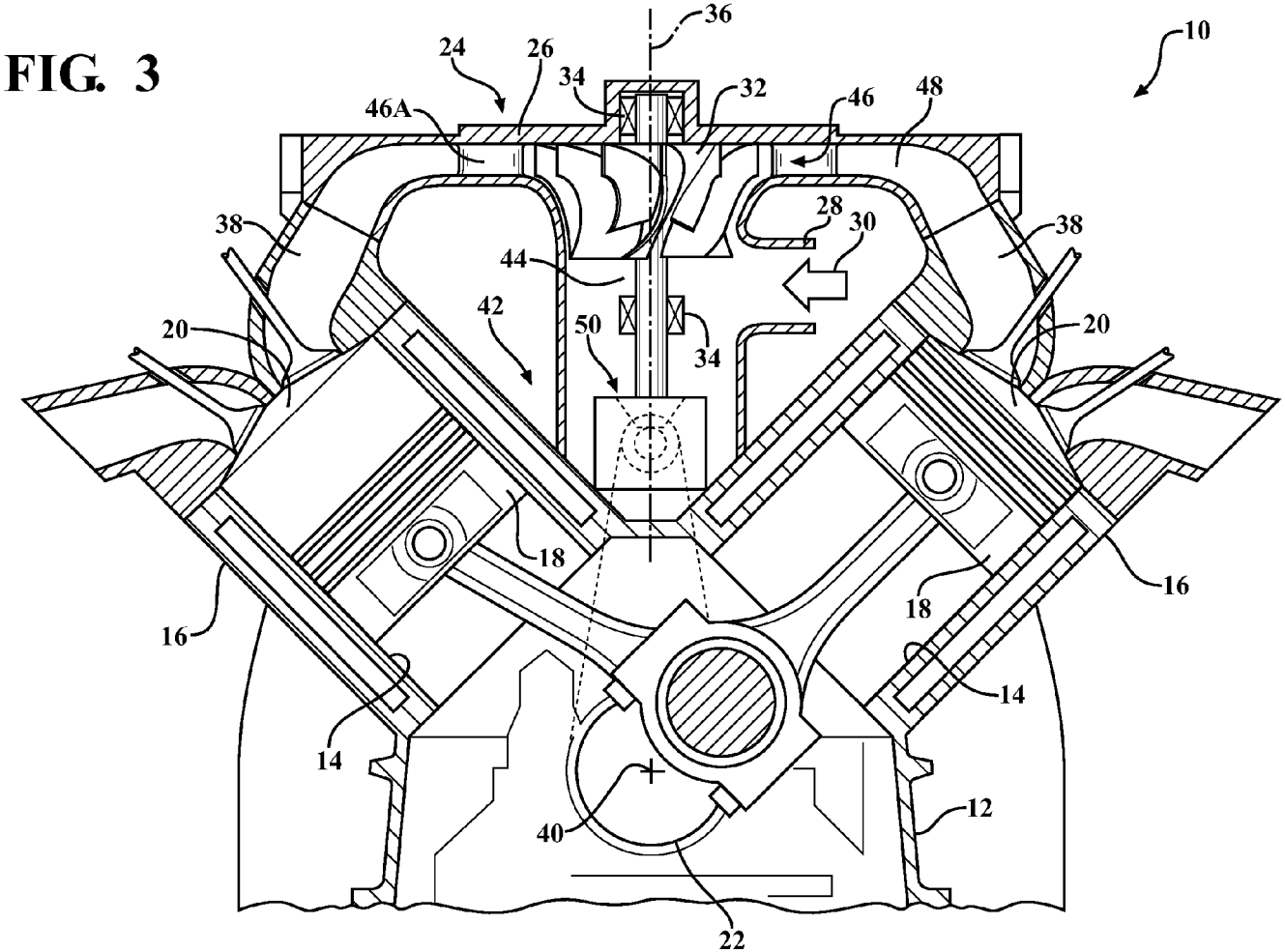
FIG. 3 is a schematic, cross-sectional view of the induction system having an integrated centrifugal compressor and a vane type of a diffuser positioned downstream of the compressor according to the embodiment shown in FIG. 1.

With continued reference to FIG. 2, the intake manifold 26 also incorporates an inlet 44 that is positioned upstream of the compressor 32 and functions to channel the ambient airflow 30 to the compressor. Along with the compressor 32 the intake manifold 26 incorporates a diffuser 46. The diffuser 46 is positioned downstream of the compressor 32 and is configured to receive the pressurized airflow therefrom. The diffuser 46 may be configured as either a vane type 46A, as shown in FIGS. 1 and 3, or a parallel- or flat-plate type 46B, as shown in FIG. 2. As additionally shown, the intake manifold 26 includes an air inlet plenum 48. The plenum 48 is positioned downstream of the diffuser 46 and configured to receive the pressurized airflow therefrom.

As a result of the intake manifold 26 incorporating the inlet 44 with the parallel-plate type of diffuser 46B and having the integrated compressor 32, the intake manifold may be devoid of a volute arrangement. As is known by those skilled in the art, a volute is a spiral-shaped scroll duct that is typically included in add-on compressor assemblies that are configured to deliver the airflow from the subject compressor to the plenum 48.

As shown in FIG. 2, the compressor 32 may be driven by the crankshaft 22 via a drive mechanism 50. The drive mechanism 50 is configured to rotate the compressor 32 and generate appropriate boost pressure according to performance parameters established for the engine 10. The drive mechanism 50 may include a gear-, a chain-, and/or a belt-drive that is operatively connected to the crankshaft 22. Alternatively, the drive mechanism 50 may include an electric motor (not shown) that is configured to rotate the compressor 32. In the preceding case, the operation of the electric motor may be regulated by a controller (not shown), such as an integrated powertrain control module (PCM), to obtain appropriate performance from the compressor 32 at specified engine speeds.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. An internal combustion engine comprising:

at least one cylinder;

a centrifugal compressor configured to rotate about a first axis and pressurize an airflow being received from the ambient;

a crankshaft configured to be rotated about a second axis by the at least one cylinder; and an intake manifold configured to channel the pressurized airflow to the at least one cylinder, and a diffuser having a volute formed in the intake manifold and positioned downstream of the compressor to receive the pressurized airflow therefrom;

wherein:

the centrifugal compressor is disposed within and integral to the intake manifold;

the centrifugal compressor is driven by the crankshaft via a drive mechanism; and the first axis is orthogonal to the second axis.

2. The engine of claim 1, wherein the intake manifold additionally includes a plenum positioned downstream of the diffuser and configured to receive the pressurized airflow therefrom.

3. The engine of claim 2, wherein:

the at least one cylinder includes a plurality of cylinders disposed in a "V" arrangement;

the intake manifold is positioned in a valley of the "V" arrangement; and the intake manifold additionally includes a plurality of runners, each runner configured to deliver the pressurized airflow to one of the plurality of cylinders.

4. The engine of claim 1, wherein the drive mechanism includes at least one of a gear-drive, a chain-drive, and a belt-drive.

5. The engine of claim 1, further comprising an intake air duct configured to deliver the airflow from the ambient to the intake manifold.

6. The engine of claim 1, wherein the diffuser is a vane type.

7. An induction system for an internal combustion engine having at least one cylinder and a crankshaft, the induction system comprising:

a centrifugal compressor configured to rotate about a first axis and pressurize an airflow being received from the ambient; and an intake manifold configured to channel the pressurized airflow to the at least one cylinder, and a diffuser having a volute formed in the intake manifold and positioned downstream of the compressor to receive the pressurized airflow therefrom;

wherein:

the centrifugal compressor is disposed within and integral to the intake manifold;

the centrifugal compressor is driven by the crankshaft via a drive mechanism;

the crankshaft is configured to be rotated about a second axis by the at least one cylinder; and the first axis is orthogonal to the second axis.

8. The induction system of claim 7, wherein the intake manifold additionally includes a plenum positioned downstream of the diffuser and configured to receive the pressurized airflow therefrom.

9. The induction system of claim 8, wherein:

the at least one cylinder includes a plurality of cylinders disposed in a "V" arrangement;

the intake manifold is configured to be positioned in a valley of the "V" arrangement; and the intake manifold additionally includes a plurality of runners, each runner configured to deliver the pressurized airflow to one of the plurality of cylinders.

10. The induction system of claim 7, wherein the drive mechanism includes at least one of a gear-drive, a chain-drive, and a belt-drive.

11. The induction system of claim 7, wherein the diffuser is a vane type.

12. An intake manifold for an internal combustion engine having at least one cylinder and a crankshaft, the intake manifold comprising:

a centrifugal compressor configured to rotate about a first axis and pressurize an airflow being received from the ambient; and a diffuser having a volute formed in the intake manifold and positioned downstream of the compressor to receive the pressurized airflow therefrom; and a plenum positioned downstream of the diffuser and configured to receive the pressurized airflow therefrom and channel the pressurized airflow to the at least one cylinder;

wherein:

the diffuser is a vane type;

the centrifugal compressor is driven by the crankshaft via a drive mechanism;

the crankshaft is configured to be rotated about a second axis by the at least one cylinder; and the first axis is orthogonal to the second axis.

13. The intake manifold of claim 12, wherein:

the at least one cylinder includes a plurality of cylinders disposed in a "V" arrangement;

the intake manifold is configured to be positioned in a valley of the "V" arrangement; and the intake manifold additionally includes a plurality of runners, each runner configured to deliver the pressurized airflow to one of the plurality of cylinders.

14. The intake manifold of claim 13, wherein drive mechanism includes at least one of a gear-drive, a chain-drive, and a belt-drive.

* * * * *